US009857156B1

(12) United States Patent
McKeon et al.

(10) Patent No.: US 9,857,156 B1
(45) Date of Patent: Jan. 2, 2018

(54) EXTENDED RANGE SUPPORT MODULE

(71) Applicants: Brian T McKeon, Portsmouth, RI (US); John Sirmalis, Barrington, RI (US); William P. Krol, Portsmouth, RI (US)

(72) Inventors: Brian T McKeon, Portsmouth, RI (US); John Sirmalis, Barrington, RI (US); William P. Krol, Portsmouth, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 152 days.

(21) Appl. No.: 14/877,025

(22) Filed: Oct. 7, 2015

(51) Int. Cl.

| | |
|---|---|
| ***B63G 8/00*** | (2006.01) |
| ***F42B 19/04*** | (2006.01) |
| ***F42B 19/06*** | (2006.01) |
| *B63G 8/18* | (2006.01) |

(52) U.S. Cl.
CPC ..... *F42B 19/04* (2013.01); *F42B 19/06* (2013.01); *B63G 8/18* (2013.01); *B63G 2008/008* (2013.01)

(58) Field of Classification Search
CPC ..... B63G 2008/007; B63G 2008/008; B63G 8/41; B63G 8/001; F42B 19/005; F42B 10/38
See application file for complete search history.

(56) References Cited

U.S. PATENT DOCUMENTS

| | | | | |
|---|---|---|---|---|
| 3,897,743 | A * | 8/1975 | Schoonman | B63G 8/001 114/321 |
| 3,999,499 | A * | 12/1976 | Kitabayashi | B63G 8/42 114/244 |
| 5,235,931 | A * | 8/1993 | Nadolink | B63G 8/00 114/257 |
| 6,854,410 | B1 * | 2/2005 | King | B63G 8/001 114/244 |
| 7,128,624 | B1 * | 10/2006 | Goldmeer | B63G 8/08 114/337 |
| 7,798,086 | B2 * | 9/2010 | Ruggaber | B63C 7/16 114/238 |
| 2014/0321236 | A1 * | 10/2014 | Lelaurin | E02D 29/06 367/15 |
| 2016/0221058 | A1 * | 8/2016 | Marx | B21D 1/12 |

* cited by examiner

*Primary Examiner* — Andrew Polay
(74) *Attorney, Agent, or Firm* — James M. Kasischke; Michael P. Stanley

(57) ABSTRACT

An extended range support module for an undersea vehicle includes an outer hull capable of accommodating the undersea vehicle therein. A navigation module is positioned on the outer hull and capable of being joined to the undersea vehicle. Controllable fins are provided on the outer hull and joined to allow control by the navigation module. A buoyancy control system is positioned within the outer hull and joined to the navigation module. An extended fuel tank is provided inside the outer hull between the outer hull and the undersea vehicle. The extended fuel tank is joined to provide fuel to the undersea vehicle. The navigation module can have GPS, inertial sensors, and sonar sensors to aid in navigation.

13 Claims, 2 Drawing Sheets

EXTENDED RANGE SUPPORT MODULE

STATEMENT OF GOVERNMENT INTEREST

The invention described herein may be manufactured and used by or for the Government of the United States of America for governmental purposes without the payment of any royalties thereon or therefor.

CROSS REFERENCE TO OTHER PATENT APPLICATIONS

None.

BACKGROUND OF THE INVENTION

(1) Field of the Invention

The present invention is a support module that can be utilized to extend the range of existing unmanned undersea vehicles.

(2) Description of the Prior Art

The United States Navy has many torpedoes and other undersea vehicles in service. These vehicles are designed primarily for submarine launch and use at limited ranges for short mission durations. The Mk-48 torpedo is typical. It is 231 inches long and has a 21 inch diameter. Various sensors including active and passive sonar are positioned on the nose of the vehicle. The vehicle has guidance and control systems that can accept commands from external sources via a data cable or a wire guide cable. This type of vehicle is typically powered by a swash plate internal combustion engine burning Otto fuel; however, it is known for unmanned undersea vehicles to be electrically powered or diesel powered. These types of vehicles would have much greater flexibility if they could be configured to operate for greater durations and longer ranges.

The U.S. Navy's Office of Naval Research has proposed a Large Displacement Unmanned Underwater Vehicle (LDUUV) concept that can be launched from a pier or a variety of ships. An embodiment of this concept is 231 inches long with a major diameter of 54 inches. The LDUUV is envisioned to have many missions that can last for as long as 70 days. The vehicle dimensions and launch equipment can be standardized to simplify logistics for world-wide operations.

U.S. Navy torpedoes are often launched in encapsulated configurations. These typically allow deployment of torpedoes from an aerial platform to the ocean surface. It is also known to deploy encapsulated torpedoes aerially from a surface platform such as a ship. Neither of these configurations allows long term deployment of a small vehicle or torpedo over an extended range.

It is desirable to use the Navy's existing stock of torpedoes and small diameter unmanned underwater vehicles in longer range missions. Use in longer range missions includes use in missions requiring enhanced navigational support to allow navigation of the vehicles in the open ocean. It is also desirable that existing launch operations conceived for LDUUV be used to accommodate these vehicles.

SUMMARY OF THE INVENTION

It is a first object of the present invention to extend the range of torpedo.

Another object is to allow long term presence of a torpedo or other small undersea vehicle at mission site.

Yet another object is to allow a torpedo or small undersea vehicle to be launched from equipment envisioned for LDUUVs.

Accordingly, there is provided an extended range support module for an undersea vehicle that includes an outer hull capable of accommodating the undersea vehicle therein. A navigation module is positioned on the outer hull and capable of being joined to the undersea vehicle. Controllable fins are provided on the outer hull and joined to allow control by the navigation module. A buoyancy control system is positioned within the outer hull and joined to the navigation module. An extended fuel tank is provided inside the outer hull between the outer hull and the undersea vehicle. The extended fuel tank is joined to provide fuel to the undersea vehicle. The navigation module can have GPS and inertial sensors to aid in navigation.

BRIEF DESCRIPTION OF THE DRAWINGS

Reference is made to the accompanying drawings in which are shown an illustrative embodiment of the invention, wherein corresponding reference characters indicate corresponding parts, and wherein.

DETAILED DESCRIPTION OF THE INVENTION

Figure 1:
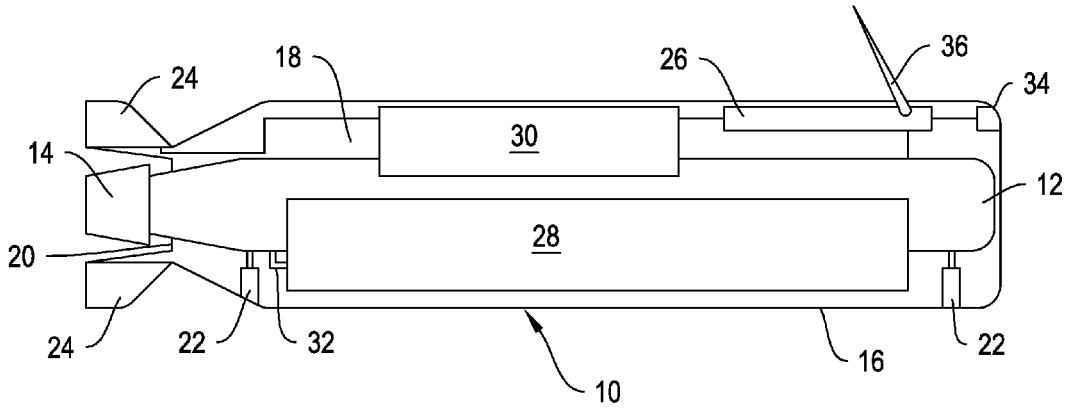
FIG. 1 is a diagram of functional blocks within an extended range support module.

In FIG. 1, there is shown a block diagram of an extended range support module 10 and a smaller undersea vehicle 12 such as a torpedo or the like. Vehicle 12 has its own propulsor 14 driven by an engine inside vehicle 12 as is known in the art. Extended range support module 10 includes an outer hull 16 having an internal cavity 18. Outer hull 16 can have an external shape conforming with that of other undersea vehicles such as LDUUVs. A propulsion aperture 20 is defined at the aft end of outer hull 16. Vehicle 12 is accommodated within internal cavity 18 with propulsor 14 extending beyond cavity 18 through propulsion aperture 20. Retaining actuators 22 can join vehicle 12 to outer hull 16. When in use, propulsion aperture 20 allows propulsor 14 to propel the combined module 10 and vehicle 12. External guidance fins 24 are positioned on the exterior of outer hull 16 at the aft end. Fins 24 are controllable by signals from a navigation system 26 joined to outer hull 16. Other fins can be provided as necessary for maneuvering and guidance.

Other resources for extended range are provided in internal cavity 18. These resources include an extended fuel tank 28 and a buoyancy control system 30. Tank 28 is joined to a fuel tank within vehicle 12 by a separable link 32 in order to provide extra fuel capacity and extended range. Extended fuel tank 28 can be a fuel bladder that collapses as fuel is used. This tank 28 can also be a rigid tank that is backfilled with seawater as fuel is used. A pump (not shown) can be joined between tank 28 and vehicle 12 fuel tank, if necessary. In an embodiment used when vehicle 12 is fueled by Otto fuel, buoyancy control system 30 can be utilized to equalize buoyancy of the combined vehicle as Otto fuel is used because Otto fuel is denser than seawater. Buoyancy control system 30 can utilize several sources of information for controlling buoyancy including depth, rate of descent/ascent, fuel consumption, and preprogrammed control signals. Buoyancy control system 30 can be a compressed gas buoyancy control system or other such system as is known in the art. Module 10 can have other external sensors 34 positioned thereon. These sensors 34 can be an acoustic sensor capable of receiving acoustic positioning signals or conducting sidescan sonar surveys of position. Other sensors can be used.

Navigation system 26 joined to outer hull 16 includes a Global Positioning System (GPS) having an antenna 36, an Inertial Navigation System (INS) and a depth sensor. Antenna 36 can be positionable from a stowed position to an extended position (shown) when module 10 is near the surface to allow GPS to obtain a coordinate fix. Coordinates can be calculated by INS when module 10 and vehicle 12 are operating below the surface. Depth sensor allows system 26 to control depth and buoyancy. At higher speeds, depth can be controlled by using steering to counteract positive or negative buoyancy. At lower speeds, depth is controlled using the buoyancy control system 30. Navigation system 26 may further include a Doppler Velocity Logger (DVL) in order to estimate speed over the ocean bottom. Navigation system 26 is joined to a control system on vehicle 12 in order to provide navigational information to control system. The connection between navigation system 26 and control system can be via a communications port on vehicle 12 or through vehicle 12's wire guide system. Control system on vehicle 12 provides control signals to fins 24 and controls propulsor 14. In an alternate configuration, navigational system 26 is capable of placing control system on vehicle 12 in a mode in which system 26 controls propulsor 14 and fins 24. Navigation system 26 or control system can trigger vehicle 12 deployment based on mission goals.

Figure 2:
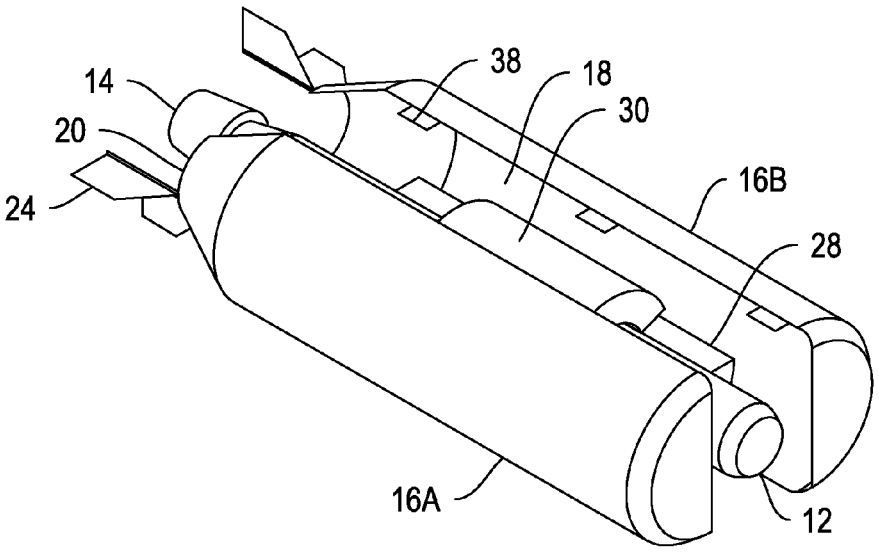
FIG. 2 is a view of an extended range support module and vehicle in accordance with one embodiment.

In a first embodiment shown in FIG. 2, deployment is achieved by separating outer hull 16 into multiple sections such as 16A and 16B. This can be performed by any of a number of different types of controllable latches 38. These can be electrically actuated or magnetic latches, exploding bolts or any other separable links. As preprogrammed or dependent on mission constraints, navigation system (not shown) or control system issues a control system to latches 38. Latches 38 part and separate outer hull 16 into sections 16A and 16B. Latches 38 can include a spring or some other biasing member for this purpose. Separable links (not shown) are also activated to separate vehicle 12 from fuel tank 28 and to separate navigation system from vehicle 12. Vehicle 12 can then execute its preprogrammed mission independent from extended range module 10.

Figure 3:
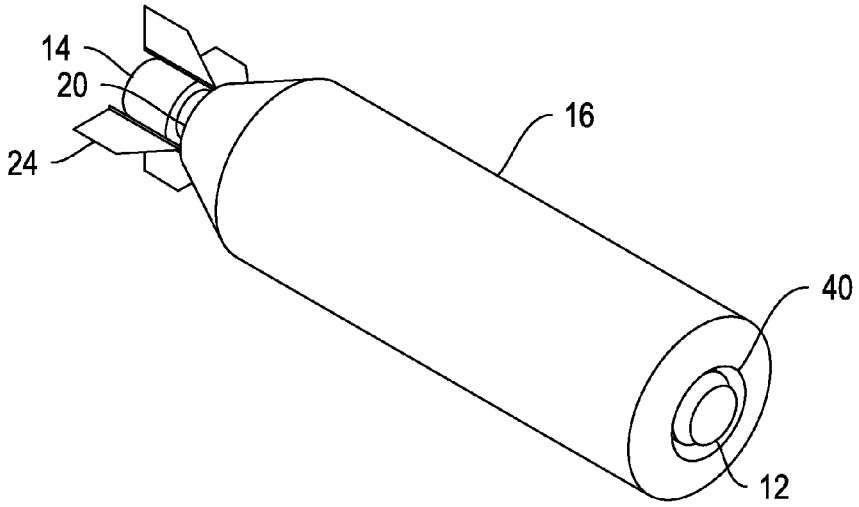
FIG. 3 is a view of an extended range support module and vehicle in accordance with another embodiment.

In a second embodiment shown in FIG. 3, outer hull 16 is made with a deployment aperture 40 in front of vehicle 12. Navigation system (not shown) or vehicle control system issues a command in accordance with preprogrammed instructions to release retaining actuators 22. Retaining actuators 22 disconnect vehicle 12 from outer hull 16. Other links between navigation system and fuel tank and vehicle are also severed. Vehicle 12 can then use its propulsor 14 to move out of extended range module 10. In this embodiment, deployment aperture 40 allows exposure of vehicle 12 sensors to environmental conditions. Vehicle sensors can be used to give information for navigation of the combined module 10 and vehicle.

It will be understood that many additional changes in the details, materials, steps and arrangement of parts, which have been herein described and illustrated in order to explain the nature of the invention, may be made by those skilled in the art within the principle and scope of the invention as expressed in the appended claims.

The foregoing description of the preferred embodiments of the invention has been presented for purposes of illustration and description only. It is not intended to be exhaustive, nor to limit the invention to the precise form disclosed; and obviously, many modification and variations are possible in light of the above teaching. Such modifications and variations that may be apparent to a person skilled in the art are intended to be included within the scope of this invention as defined by the accompanying claims.

What is claimed is:

1. An extended range support module for an undersea vehicle comprising:

an outer hull capable of accommodating the undersea vehicle therein;

a navigation module positioned on said outer hull and capable of being joined to the undersea vehicle;

controllable fins positioned on said outer hull and joined to allow control by said navigation module;

a buoyancy control system positioned within the outer hull and joined to said navigation module; and an extended fuel tank positionable within said outer hull between said outer hull and the undersea vehicle, capable of being joined in fluid communication with the undersea vehicle.

2. The apparatus of claim 1 wherein the navigation module comprises:

a global positioning system receiver; and an inertial navigation system.

3. The apparatus of claim 2 wherein the navigation module further comprises a Doppler velocity logger for providing velocity information to said navigation module.

4. The apparatus of claim 2 further comprising an antenna positioned on a top surface of said outer hull and joined to global positioning system receiver in said navigation module.

5. The apparatus of claim 4 wherein said antenna is positionable from a stowed position against said outer hull to a deployed position extending outward and above said outer hull.

6. The apparatus of claim 5 wherein said navigation system is capable of detecting depth and said antenna is positioned to the deployed position when said antenna is sufficiently near the surface to receive GPS signals.

7. The apparatus of claim 1 wherein said outer hull can be separated from the undersea vehicle after the combined extended range support module and undersea vehicle has been deployed.

8. The apparatus of claim 7 wherein said outer hull is made in at least two hull portions that can be separated from each other to deploy the undersea vehicle.

9. The apparatus of claim 8 wherein the at least two hull portions are held together by releasable fasteners.

10. An extended range support module for an undersea vehicle comprising:

an outer hull capable of accommodating the undersea vehicle therein wherein said outer hull can be separated from the undersea vehicle after the combined extended range support module and undersea vehicle has been deployed;

a navigation module positioned on said outer hull and capable of being joined to the undersea vehicle;

controllable fins positioned on said outer hull and joined to allow control by said navigation module;

a buoyancy control system positioned within the outer hull and joined to said navigation module; and an extended fuel tank positionable within said outer hull between said outer hull and the undersea vehicle, capable of being joined in fluid communication with the undersea vehicle;

wherein said outer hull has a deployment aperture formed therein and further comprising a plurality of retaining actuators joinable between said outer hull and the undersea vehicle, said plurality of retaining actuators being joined to said navigation module and capable of releasing the undersea vehicle on command therefrom.

11. The apparatus of claim 1 further comprising a neutral buoyancy system positioned within said outer hull, said neutral buoyancy system being capable of maintaining a buoyancy for the for the combined module and undersea vehicle during operation.

12. The apparatus of claim 1 wherein said outer hull is externally dimensioned to conform in shape with preexisting undersea vehicles.

13. The apparatus of claim 1 wherein said extended fuel tank comprises a fuel bladder that is capable of collapsing as fuel is utilized.

* * * * *